United States Patent [19]

Yoshioka

[11] Patent Number: 4,633,792

[45] Date of Patent: Jan. 6, 1987

[54] APPARATUS FOR SEWING SLIDE FASTENERS TO PAIRS OF FABRIC PIECES

[75] Inventor: Hiroshi Yoshioka, Namerikawa, Japan

[73] Assignee: Yoshida Kogyo K.K., Tokyo, Japan

[21] Appl. No.: 837,591

[22] Filed: Mar. 7, 1986

[30] Foreign Application Priority Data

Mar. 8, 1985 [JP] Japan ..... 60-45884

[51] Int. Cl.[4] ..... D05B 3/12

[52] U.S. Cl. ..... 112/104; 112/121.27; 112/265.2

[58] Field of Search ..... 112/104, 121.26, 121.27, 112/121.12, 121.15, 113, 152, 265.2, 265.1, 114, 307

[56] References Cited

U.S. PATENT DOCUMENTS

| | | | |
|---|---|---|---|
| 3,710,745 | 1/1973 | Yoshikawa | 112/265.2 |
| 4,006,695 | 2/1977 | Van Amberg | 112/104 |
| 4,131,077 | 12/1978 | Boser | 112/265.2 |
| 4,137,859 | 2/1979 | Itoh | 112/265.2 |
| 4,274,347 | 6/1981 | Rohrer | 112/104 |
| 4,497,270 | 2/1985 | Boser | 112/104 X |
| 4,541,352 | 9/1985 | Boser et al. | 112/265.2 |

FOREIGN PATENT DOCUMENTS

| | | |
|---|---|---|
| 47-16295 | 6/1972 | Japan . |
| 48-31335 | 9/1973 | Japan . |

*Primary Examiner*—H. Hampton Hunter

*Attorney, Agent, or Firm*—Hill, Van Santen, Steadman & Simpson

[57] ABSTRACT

A slide fastener is sewn to a pair of fabric pieces in a sewing station defined by a double-needle sewing machine. A pair of fastener stringers is twisted around in mirror symmetry with respect to the longitudinal centerline of the slide fastener. A slider, which is slidable on and along the fastener stringers, is temporarily held by a slider holder disposed upstream of and adjacent to the sewing station. As the sewing operation progresses and until after the engagement of the slider with the bottom end portion of the slide fastener, the pair of fastener stringers are automatically progressively uncoupled. The further movement of the slide fastener causes the slider to be forced by the bottom end portion of the slide fastener past the slider holder.

14 Claims, 14 Drawing Figures

APPARATUS FOR SEWING SLIDE FASTENERS TO PAIRS OF FABRIC PIECES

BACKGROUND OF THE INVENTION

1. Field of the Invention

The present invention relates to a method of, and an apparatus for, sewing a slide fastener to a pair of fabric pieces, such as, for example, of a curtain, a tent or a garment.

2. Prior Art

Conventionally, for attaching a slide fastener to a pair of fabric pieces on a sewing machine, a slider is manually moved to a bottom end portion of the slide fastener to uncouple a pair of opposed fastener stringers of the slide fastener except at their bottom end portions. The uncoupled stringers are introduced, as superimposed over the respective fabric pieces, to a sewing station of the sewing machine from a top end portion of the slide fastener, while the fastener stringers are being twisted in mirror symmetry with respect to the longitudinal centerline of the slide fastener so that a pair of initially opposed rows of coupling elements is directed away from one another. The pair of fastener stringers are sewn by a pair of reciprocating sewing needles to the respective fabric pieces from the top end portion of the slide fastener in the sewing station.

Such conventional sewing practice is disadvantageous however in that the two substantially fully uncoupled fastener stringers are likely to displace from one another in a longitudinal direction due to tensioning forces applied thereto during sewing operation. Because of this relative displacement, the fastener stringers with the fabric pieces sewn thereto cannot be coupled together smoothly and quickly. When fully closed, the slide fastener having such displaced stringers becomes wavy or undulated, making the fabric pieces become defective from an aesthetic view. The conventional sewing practice is not suitable in applications wherein the pair of fabric pieces have design patterns printed thereon and a mutual matching or alignment of such design patterns across the slide fastener is a major requirement. Due to the reliance on time-consuming manual opening of the slide fastener, sewing efficiency is very low. When sewing a remarkably long slide fastener, it occurs likely that a pair of opposed fastener stringers is unintentionally twisted in asymmetry. The fastener stringers sewn to the respective fabric pieces cannot be coupled together smoothly due to occurrence of an objectionable inward bulge of the fabric pieces between the opposed stringers.

Typical examples of the foregoing sewing practice are disclosed in Japanese Utility Model Publication No. 47-16295 and Japanese Patent Publication No. 48-31335.

SUMMARY OF THE INVENTION

It is accordingly a principal object of the present invention to provide a method and apparatus for sewing a slide fastener to a pair of fabric pieces without occurrence of any difficulty associated with the prior sewing practice.

A more specific object of the present invention is to provide a method and apparatus for sewing a slide fasteners to a pair of fabric pieces, in which a pair of fastener stringers of the slide fastener can be secured neatly to the respective fabric pieces without causing relative displacement during the sewing operation.

A further object of the present invention is to provide a method and apparatus for sewing a slide fastener to a pair of fabric pieces efficiently.

Another object of the present invention is to provide a method and apparatus for sewing a slide fastener to a pair of fabric pieces, in which a pair of fastener stringers of the slide fastener with the fabric pieces sewn thereto can be coupled together smoothly and quickly without occurrence of any inward bulge of the fabric pieces between the opposed stringers.

According to the present invention, a slide fastener is to be sewn to a pair of fabric pieces in a sewing station defined by a double-needle sewing machine. A pair of fastener stringers is twisted around in mirror symmetry with respect to the longitudinal centerline of the slide fastener. A slider, which is slidable on and along the fastener stringers, is temporarily held by a slider holder disposed upstream of and adjacent to the sewing station. As the sewing operation progresses, the pair of fastener stringers are automatically progressively uncoupled until the slider is engaged by a bottom end portion. The further movement of the slide fastener causes the slider to be forced by the bottom end portion of the slide fastener past the slider holder.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

FIGS. 1 through 6 show an apparatus for sewing a concealed slide fastener 1 to a pair of fabric pieces 2, 2 across an opening 3 defined by the fabric pieces 2, 2.

Figure 1:
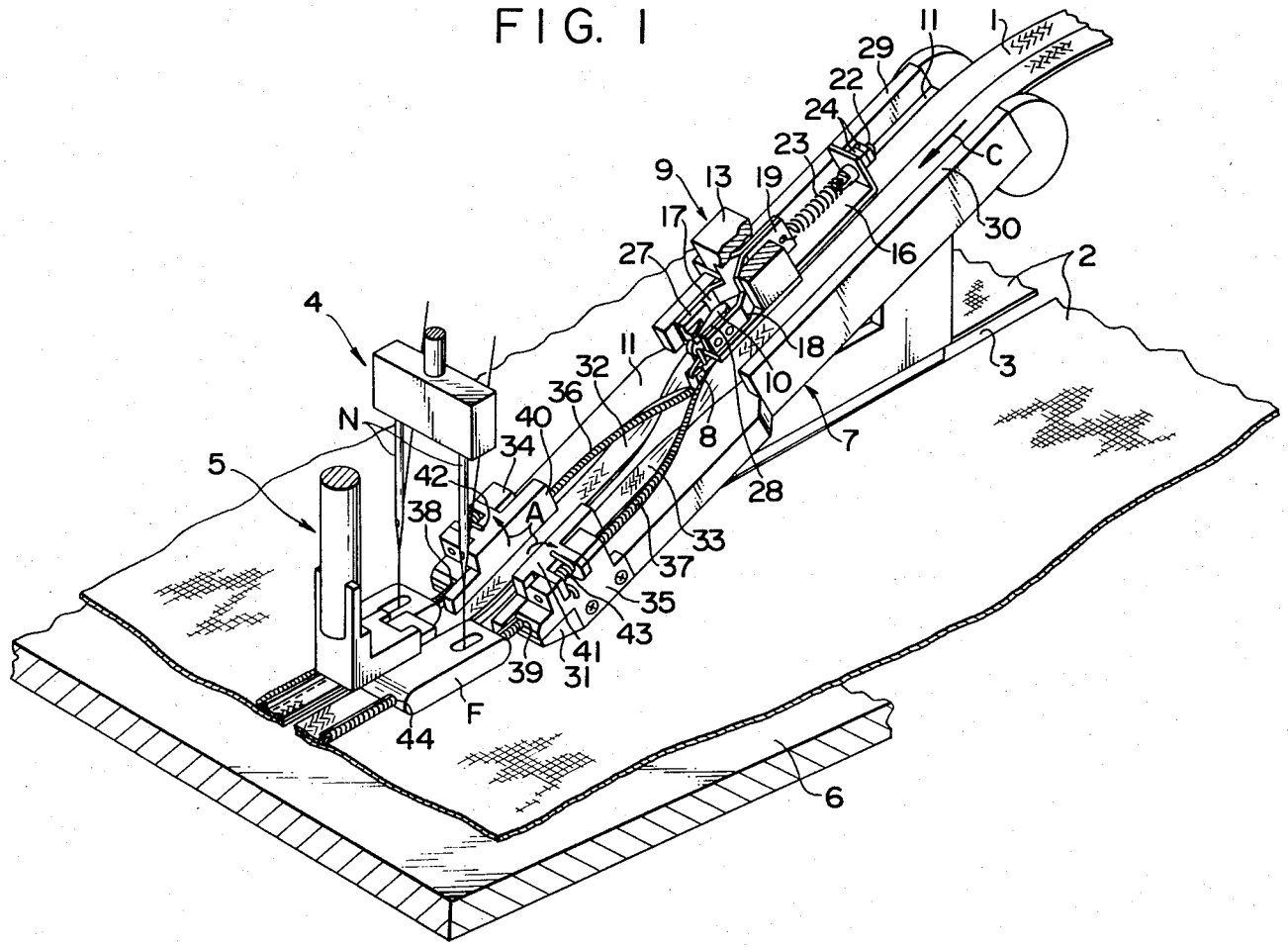
FIG. 1 is a fragmentary perspective, partly cut away view of an apparatus embodying the present invention.
Figure 2:
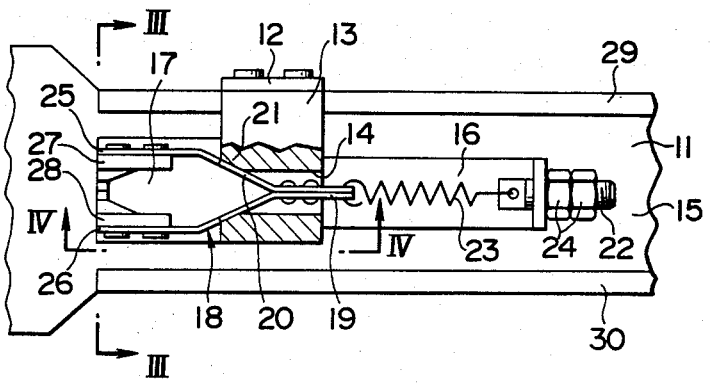
FIG. 2 is an enlarged plan view, partly in cross section, of a slider holder of the apparatus shown in FIG. 1.
Figure 3:
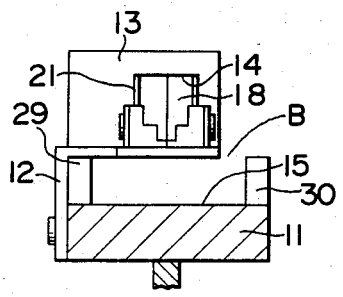
FIG. 3 is a cross-sectional view taken along line III—III of FIG. 2.

As shown in FIG. 1, the apparatus generally comprises a double-needle sewing machine 4 mounted on a table 6 and defining a sewing station 5, a fabric-piece guide unit (not shown) disposed upstream of the sewing station 5 for guiding the fabric pieces 2, 2 in laterally spaced relationship to the sewing station 5, and a slide-fastener guide unit 7 supported on the table 6 and disposed above the non-illustrated fabric-piece feed unit for guiding the slide fastener 1 as the latter is fed toward the sewing station 5.

The slide-fastener guide unit 7 supports on its upper surface a slider holder 9 for releasably holding a slider 8 of the slide fastener 1, the slider holder 9 being disposed adjacent to the sewing station 5.

The slider holder 9 is so constructed as to hold the slider 8 by gripping a pull tab 10 of the slider 8. As shown in FIGS. 2 through 6, the slider holder 9 includes a bracket 12 secured to a slanted elongate guide plate 11 of the slide-fastener guide unit 7 (FIG. 1). The bracket 12 supports thereon an inverted U-shaped cover 13 having a downwardly opening groove 14 facing a slide-fastener guide track 15 defined on the guide plate 11. The slider holder 9 also includes a support plate 16 extending from an end of the cover 13 remote from the sewing station 5 (FIG. 1) to overlie the guide track 15. The cover 13 is vertically spaced from the guide track 15 to define therebetween a space B (FIG. 3) which is large enough to allow the slider 8 to pass through the space B while the pull tab 10 is being held in a recumbent position.

The groove 14 extends through the cover 13 in the longitudinal direction of the guide track 15 and receives a part of a generally Y-shaped gripper 18 with an outwardly flaring bay 17 of the gripper 18 opening toward the sewing station 5 (FIG. 1). The gripper 18 is composed of a pair of leaf springs joined together at one end and bent into a Y-shape including a stem or leg 19 and a bifurcated resilient head 20. The closed end portion of the head 20 is complementary in contour with an outwardly flared end 21 of the groove 14. A tension spring 23 is connected at its opposite ends with the leg 19 of the gripper 18 and a bolt 22 secured to a distal end of the support plate 16 so that the bifurcated resilient head 20 of the gripper 18 is urged against the flared end 21 of the groove 14 to resiliently deform in a direction to narrow the bay 17.

The spring 23 has a spring force large enough to enable the slider holder 9 to hold the slider 8 thereon against a tensioning force applied to the slide fastener 1 until the tensioning force reaches a predetermined value. When subjected to the tensioning force above the predetermined value, the spring 23 yields, thereby releasing the slider 8 from the slider holder 9. The bolt 22 is coupled with a pair of nuts 24, 24 (FIG. 2) for axial movement so that the force of the tension spring 23 is adjustable with the axial displacement of the bolt 22.

The resilient bifurcated head portion 20 of the gripper 18 includes a pair of opposed grip fingers 25, 26 supporting, at their distal ends, a pair of opposed presser pads 27, 28, respectively, the presser pads 27, 28 projecting into the bay 17 for gripping the slider pull tab 10 therebetween.

As shown in FIG. 1, the guide plate 11 of the slide-fastener guide unit 7 inclines progressively downwardly toward the sewing station 5 and has a pair of parallel spaced guard flanges 29, 30 extending along opposite longitudinal edges of the guide plate 11. The guard flanges 29, 30 extend from an upper end of the slanted guide plate 11 toward the sewing station 5 and terminate adjacent to the head portion 20 (FIG. 2) of the gripper 18. The portion of the guide plate 11, which extends downstream of the guard flanges 29, 30, is enlarged widthwise. The guide plate 11 has a lower end 31 facing the sewing station 5 and supporting thereon a pair of coupling-assembly guides 34, 35 laterally spaced from each other for guiding a pair of coupling element assemblies 36, 37, respectively. The coupling assemblies 36, 37 are composed of inner longitudinal edges (not designated) of a pair of opposed fastener stringers 32, 33 and a pair of rows of coupling elements (not designated) supported on the respective inner longitudinal edges.

The fastener stringers 32, 33 are initially fully coupled and they are progressively uncoupled from one another as the slide fastener 1 is fed toward the sewing station 5 while the slider 8 is being held on the slider holder 9. The uncoupled fastener, stringers 32, 33 are twisted around to direct the coupling element assemblies 36, 37 away from each other. The coupling element assemblies 36, 37 are then introduced into the coupling-assembly guides 34, 35.

The coupling-assembly guides 34, 35 have a pair of longitudinal grooves 38, 39 defined in inner lower corners, respectively, thereof in confronting relation to each other and extending over the full length of the guides 34, 35 for guiding the coupling element assemblies 36, 37 as they pass through the grooves 38, 39 in erected posture. A pair of presser plates 40, 41 is pivotably mounted on the guides 34, 35, respectively, and they are normally urged by a pair of torsion springs 42, 43 to swing in a direction to close the respective grooves 38, 39. The presser plates 40, 41 are pivotally movable, against the force of the springs 42, 43, to swing in the direction indicated by the arrow A (FIG. 1) in response to engagement with the slider 8 held at a connected bottom end portion of the slide fastener 1, thereby allowing passage of the slide fastener 1 through the guides 34, 35.

In the sewing station, there are a pair of parallel sewing needles N, N vertically reciprocably mounted on a sewing machine body (not shown), and a presser foot F mounted on the sewing machine body and having a pair of downwardly opening grooves, 44 (one shown in FIG. 1) for the passage of the erected coupling assemblies 36, 37. The fastener stringers 36, 37, as they are fed through the presser foot F, are sewn to the opposed edges of the fabric pieces 2, 2 across the opening 3 with a pair of rows of sewing stitches extending along the inner longitudinal edges of the respective fastener stringers 32, 33 adjacent to the coupling elements.

Figure 7:
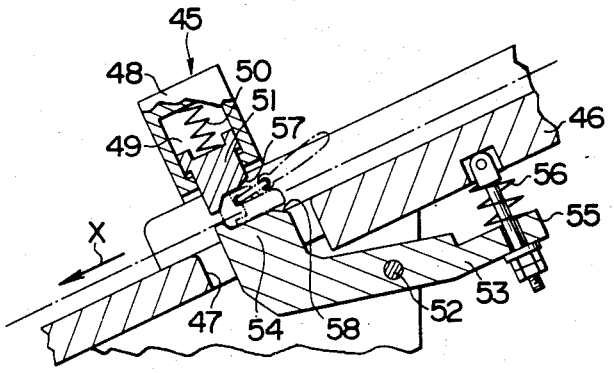
FIG. 7 is a fragmentary schematic longitudinal cross-sectional view of a modified slider holder.

Since the slider holder 9 is so constructed to hold the slider 8 by gripping the slider pull tab 10, it is suitable for use with auto-lock sliders which comprise a resilient locking pawl (not shown) operatively connected to the pull tab 10 and normally held in interlocking engagement with the coupling elements to lock the slider on the slide fastener against displacement, the locking pawl being disengaged from the coupling elements when the pull tab is pulled. When sewing slide fasteners with sliders of general or non-auto-lock sliders, the apparatus preferably comprises a modified slider holder 45 shown in FIG. 7.

The slider holder 45 includes a bracket 48 secured to a guide plate 46 to overlie the latter in registry with a through-hole 47 defined in the guide plate 46. The bracket 48 includes a recess 49 in which an upper presser finger 51 is movably received. A compression coil spring 50 is received in the recess 49 and acts between the bracket 48 and the presser finger 51 to urge the latter to partly project from the bracket 48 toward a guide track (not designated) defined on the guide plate 46. The slider holder 45 also includes a rocking arm 53 pivotably supported by a pin 52 below the guide plate 46. The rocking arm 53 has, at its one end, a lower presser finger 54 received in the through-hole 47 in alignment with the upper presser finger 51 and normally projecting upwardly beyond the guide track. The other end 55 of the rocking arm 53 is resiliently connected to the guide plate 46 with a compression coil spring 56 interposed therebetween, so that the lower presser finger 54 is normally urged by the spring 56 in the blocking position of FIG. 7. The upper and lower presser fingers 51, 54 have a pair of sloped guide surfaces 57, 58, respectively, facing in an upstream direction of the guide track for smooth reception of a slider (illustrated by phantom lines) between the presser fingers 51, 54.

In operation, a fully closed slide fastener (not shown) with a non-auto-lock slider held near a top or leading end thereof is fed in a direction of the arrow X along the guide track on the guide plate 46. While the slide fastener is being fed, the slider is passed through and is guided by the guide surfaces 57, 58 of the respective presser fingers 51, 54, is caught by the presser fingers 51, 54, and remains gripped therebetween until the slider is engaged by a connected bottom or trailing end portion of the slide fastener. During that time and up to such engagement, the initially coupled opposed fastener stringers are separated from one another, except the connected bottom end of the slide fastener, by the slider in response to the continued feeding of the slide fastener. The further movement of the slide fastener causes the slider to be forced by the connected bottom end portion of the slide fastener past the presser fingers 51, 54 against the combined force of the springs 50, 56.

Figure 8A:
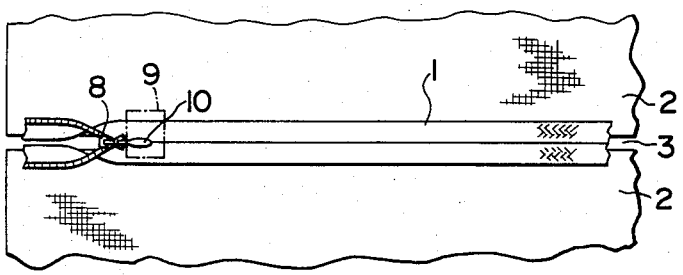
FIG. 8A is a plan view of a concealed slide fastener in the initial sewing stage with a slider held by the slider holder of FIG. 2.
Figure 8B:
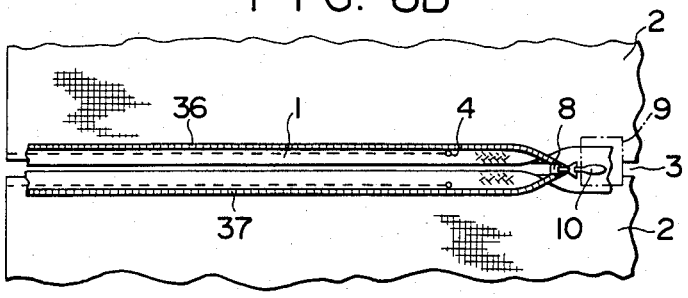
FIG. 8B is a view similar to FIG. 8A, showing the positional relationship between the concealed slide fastener and the slider holder in an advanced sewing stage.
Figure 8C:
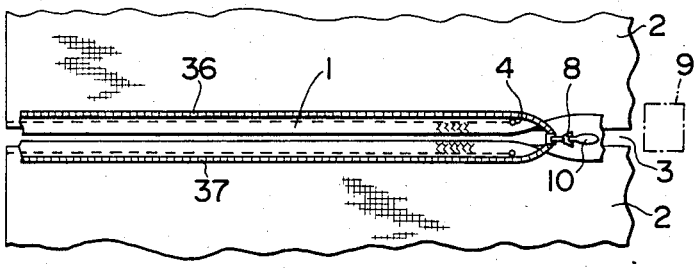
FIG. 8C is a plan view of the concealed slide fastener with the slider just released from the slider holder.

The manner in which a concealed slide fastener 1 with an auto-lock slider 8 mounted thereon is sewn to a pair of fabric pieces 2, 2 on the apparatus of FIGS. 1 through 6 is described hereinbelow in connection with FIGS. 8A through 8C.

Before the start of sewing work, a pair of fabric pieces 2, 2 is introduced into the sewing station 5 (FIG. 1), while a concealed slide fastener 1 is placed on the guide track 15 of the guide plate 11 upstream of the slider holder 9, with the slider 8 held against top end stops (not shown) of the slide fastener 1 to fully close the slide fastener 1. The slide fastener 1 is inserted into the space B (FIG. 3) between the cover 13 and guide track 15 and then is pulled forwardly in a direction of the arrow C (FIG. 1) toward the sewing station 5 to such an extent that a top or leading end of the slide fastener 1 reaches the sewing station 5. The slide 8, which has advanced beyond the slider holder 9, is manually moved toward the slider holder 9 to uncouple the respective fastener stringers 32, 33 from the top end of the slide fastener 1. (This manual operation of the slider is not necessary when sewing a slide fastener wherein a distance between a top end of the slide fastener and a top end of a pair of interengaged rows of coupling assemblies, at which a slider is located, is greater than the distance between the sewing station 5 and the slider holder 9.) The uncoupled portions of the respective fastener stringers 32, 33 are then twisted around in opposite directions to direct the coupling element assemblies 36, 37 away from each other, as shown in FIG. 8A. The two twisted stringers 32, 33 are passed though the respective guides 34, 35 with the coupling assemblies 36, 37 guided in the respective grooves 38, 39 in the guides 34, 35, and then are introduced into the sewing station 5 with the coupling element assemblies 36, 37 guided in the grooves 44 in the presser foot F.

Figure 4:
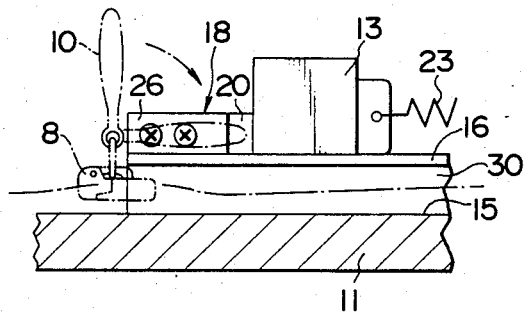
FIG. 4 is a cross-sectional view taken along line IV—IV of FIG. 2.
Figure 5:
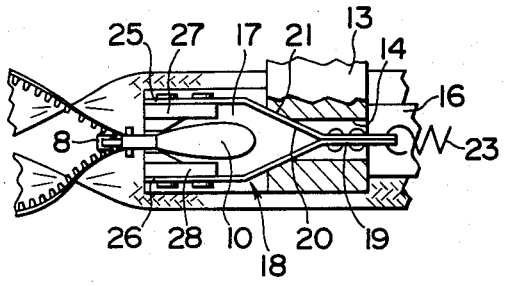
FIGS. 5 and 6 are fragmentary plan views partly in cross section, of the slider holder, illustrating how the slider holder operates.
Figure 6:
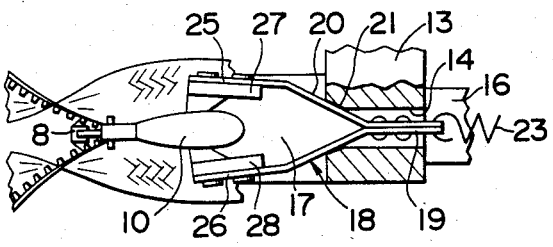

Subsequently, the gripper 18 is manually pulled away from the cover 13 against the force of the tension spring 23. While maintaining this condition, the pull tab 10 of the slider 8 is forced into the bay 17 in the gripper 18 and then is caught by the presser pads 27, 28, as shown in FIGS. 4 and 5. Now, the slide fastener 1 and the fabric pieces 2, 2 are held in the position of FIG. 8A in which the twisted uncoupled portions of the respective stringers 32, 33 are superimposed over the respective fabric pieces 2, 2, the sewing needles N, N and the presser foot F being omitted for clarity.

Then a start button (not shown) is depressed whereupon the presser foot F and the sewing needles N, N descend, and the sewing operation starts. Throughout the sewing operation, the sewn article, i.e. the slide fastener 1 and the fabric pieces 2, 2 are advanced by the feed dog (not shown) of the sewing machine. Since the slider 8 is locked in position on the slider holder 9, the fastener stringers 32, 32 are automatically progressively uncoupled and sewn to the fabric pieces as the sewing operation proceeds.

As the slide fastener 1 is advanced, the slider 8 is brought into engagement with the connected bottom end portion of the slide fastener 1 whereupon the slider 8 is subjected to the tensioning force applied to the stringers 32, 33 by the feed dog. The further movement of the slide fastener 1 causes the resilient head 21 of the gripper 18 to disengage from the cover 13 against the force of the tension spring 23 (FIGS. 6 and 8(B)). Subsequently, the slider 8 and the pull tab 11 are forced by the bottom end portion of the slide fastener, to move past the presser pads 27, 28 against the resiliency of the head 21 of the gripper 18 (FIG. 8C).

Figure 9:
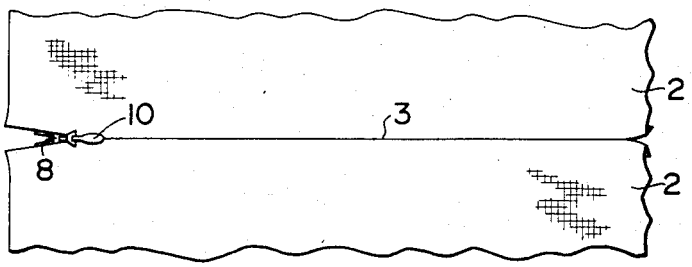
FIG. 9 is a fragmentary plan view of a pair of opposed fabric pieces coupled together by the concealed slide fastener sewn thereto.

As the bottom end of the slide fastener 1, where the slider 1 is positioned, reaches the guides 34, 35, the presser plates 40, 41 are angularly moved upwardly (arrows A in FIG. 1) by the coupling element assemblies 36, 37 against the bias of the torsion springs 42, 43, for thereby allowing the connected bottom end of the slide fastener 1 to pass through the guides 34, 35 unobstructedly. Subsequently, when the slider 8, disposed at the connected bottom end of the slide fastener 1, approaches the sewing station 5, a slider detector (not shown) issues a command signal to the sewing machine 4 to start back tucking. The sewing threads are cut and the presser foot F is then raised to terminate the operation of the sewing machine 4. As shown in FIG. 8C, the sewing stitches extend from the top or the leading end of the slide fastener 1 and terminate short of the slider 8 disposed at the connected bottom or the trailing end of the slide fastener 1. Upon sliding movement of the slider 8 to the top end of the slide fastener 1, the opening 3 between the fabric pieces 2, 2 is fully closed, as shown in FIG. 9.

The apparatus of the present invention is especially useful in the sewing of concealed slide fasteners, as described above. However, it is clear that non-concealed or exposed slide fasteners may be well sewn with the apparatus of the invention. Such assembly is illustrated in FIGS. 10A and 10B.

Figure 10A:
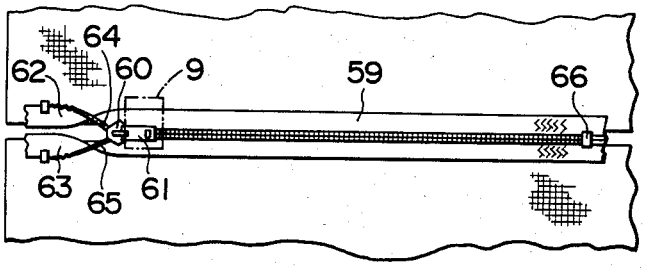
FIGS. 10A and 10B are views corresponding to FIGS. 9A and 9C, respectively, showing successive steps of the present sewing method as applied to the sewing of a non-concealed or exposed slide fastener to a pair of fabric pieces.
Figure 10B:
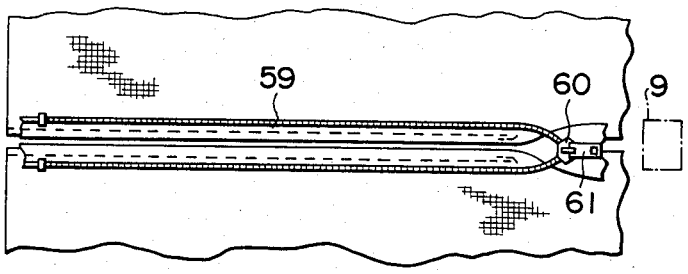
Figure 11:
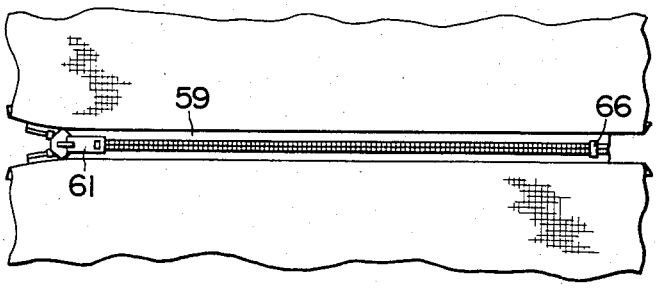
FIG. 11 is a fragmentary plan view of the opposed fabric pieces coupled together by the exposed slide fastener sewn thereto.

As shown in FIG. 10A, before being sewn to a pair of opposed fabric pieces (not designated), an exposed slide fastener 59 is opened from its top end to an extent by moving a slider 60 toward a bottom stop 66 secured to a bottom end portion of the slide fastener 59. The uncoupled stringers 62, 63 are twisted around to direct initially opposed coupling elements 64, 65 away from each other. Then a pull tab 61 of the slider 60 is held on the slider holder 9. As the sewing operation progresses, the stringers 62, 63 are automatically progressively uncoupled from one another until the slider 60 is engaged by the bottom stop 66. The further movement of the fastener stringers 62, 63 causes the slider 60 to be forced by the bottom stop 66 past the slider holder 9, as shown in FIG. 10B. The exposed slide fastener 59 thus sewn to the pair of fabric pieces is shown in FIG. 11, the fastener 59 being fully closed by the slider 60.

In the sewing of the exposed slide fastener 59, the guides 34, 35 and the presser foot F shown in FIG. 1 are replaced respectively by a pair of guides and a presser (neither shown) which are modified to have respective guide grooves capable of guiding the coupling elements 64, 65 during the sewing operation.

As described above, according to the present method, since the slider holding station, where two fastener stringers are automatically progressively uncoupled, is disposed adjacent to the sewing station, the uncoupled portions of the respective stringers are relatively short and hence they are unlikely to displace in a longitudinal direction with respect to one another when subjected to a tensioning force during the sewing operation. The fastener stringers free of relative displacement can be sewn neatly to the fabric pieces. Because of automatic uncoupling of the pair of fastener stringers, sewing efficiency is very high even when remarkably long slide fasteners are to be secured. Because of the close positioning of the sewing station and the slider holding position, unintentional asymmetric twisting of the uncoupled stringer portions can be prevented. The stringers with the fabric pieces sewn thereto can be coupled together smoothly without occurrence of any inward bulge of the fabric pieces between the opposed stringers.

According to the present apparatus, automatic uncoupling of the pair of fastener stringers and automatic releasing of the slider can be achieved by the slider holder disposed on the fastener guide adjacent to the sewing station. The slider holder is simple in construction and can be manufactured at low cost.

Obviously, many modifications and variations of the present invention are possible in the light of the above teachings. It is therefore to be understood that within the scope of the appended claims, the invention may be practiced otherwise than as specifically described.

What is claimed is:

1. An apparatus for sewing a slide fastener to a pair of fabric pieces, the slide fastener including a pair of fastener stringers and a slider movable on and along the fastener stringers for opening and closing a slide fastener, the slider including a pivotally movable pull tab, said apparatus comprising:

(a) a table;

(b) a sewing station defined by a double-needle sewing machine mounted on said table for receiving the slide fastener and the pair of fabric pieces in respective superimposed relationship;

(c) a first guide disposed upstream of said sewing station for guiding the pair of fabric peices in lateral spaced relation to said sewing station;

(d) a second guide supported on said table and disposed above said first guide for supporting the slide fastener with the pair of fastener stringers partially uncoupled from a top end portion of the slide fastener, and for guiding the uncoupled portions of the pair of fastener stringers to said sewing station so as to turn the uncoupled stringer portions upside down so that the uncoupled stringer portions assume twisted positions in mirror symmetry with respect to the longitudinal centerline of the slide fastner; and (e) a slider holder disposed on said second guide adjacent to said sewing station, for temporarily holding the slider, said slider holder yieldably releasing the slider in response to the engagement of a bottom portion of the slide fastener with the slider, thereby automatically progressively uncoupling the pair of fastener stringers while said sewing machine is operating.

2. An apparatus according to claim 1, said slider holder including a pair of grip fingers urged toward each other to arrest the movement of the slider until after the slider is engaged by the bottom end portion of the slide fastener.

3. An apparatus according to claim 2, said grip fingers being disposed in a plane parallel to the general plane of the slide fastener.

4. An apparatus according to claim 2, said grip fingers being disposed in a plane perpendicular to the general plane of the slide fastener.

5. An apparatus according to claim 5, said second guide including a guide plate defining thereon a guide track along which the slide fastener is fed, said slider holder including a cover mounted on said guide plate above said guide track and having a groove extending longitudinally of said guide track, said slider holder further including a generally Y-shaped gripper having a leg received in said groove and a bifurcated resilient head projecting outwardly from said groove toward said sewing station and lockingly engageable with said slider, and means for urging said gripper away from said sewing station to thereby contract said resilient head.

6. An apparatus according to claim 5, said groove having a flared end facing toward said sewing station, said bifurcated resilient head of said Y-shaped gripper having a connected end portion complementary in contour with said flared end of said groove.

7. An apparatus according to claim 5, said slider holder further including a support plate extending in alignment with said groove away from said sewing station, and a bolt secured to a distal end of said support plate, said urging means comprising a tension spring acting between said leg of said Y-shaped gripper and said bolt.

8. An apparatus according to claim 7, said bolt being adjustably movable for axial displacement.

9. An apparatus according to claim 5, said Y-shaped gripper including a pair of opposed presser pads disposed at an open end of said bifurcated resilient head.

10. An apparatus according to claim 5, said Y-shaped gripper comprising a pair of leaf springs joined together at one end and bent into a Y-shape.

11. An apparatus according to claim 1, said second guide including a guide plate defining thereon a guide track along which the slide fastener is fed, and a through-hole communicating with said guide track, said slider holder including an upper grip finger resiliently movably disposed above said guide track in registry with said through-hole, and a lower grip finger resiliently movably received in said through-hole and partly projecting into said guide track, said upper and lower grip fingers being resiliently urged toward each other to hold the slider therebetween.

12. An apparatus according to claim 11, said slider holder including a bracket mounted on said guide plate above said guide track and having a recess opening to said guide track, said upper grip finger being movably retained in said recess, and a compression coil spring received in said recess and acting between said bracket and said upper grip finger to urge the latter toward said guide track.

13. An apparatus according to claim 11, said slider holder including a rocking arm pivotably mounted on said second guide below said guide plate, said lower grip finger being disposed at one end of said rocking arm, and a compression coil spring acting between said guide plate and the other end of said rocking arm to urge said lower grip finger toward said upper grip finger.

14. An apparatus according to claim 11, said upper and lower grip fingers having a pair of sloped guide surfaces, respectively, facing toward an upstream direction of said guide track.

* * * * *